United States Patent [19]

Cichonski

[11] 4,381,627

[45] May 3, 1983

[54] NARROW PROFILE JAMB WINDOW

[75] Inventor: Walter E. Cichonski, Philadelphia, Pa.

[73] Assignee: Stephen Laurie Manufacturing Company, Inc., Bristol, Pa.

[21] Appl. No.: 205,149

[22] Filed: Nov. 10, 1980

[51] Int. Cl.[3] ..... E05D 15/06

[52] U.S. Cl. ..... 49/453; 49/484; 49/458

[58] Field of Search ..... 49/484, 458, 495, 406, 49/404

[56] References Cited

U.S. PATENT DOCUMENTS 3,105,576 10/1963 Jones et al. ..... 49/458 X 3,750,338 8/1973 Lissarrague ..... 49/458 X 3,810,331 5/1974 McCurdy et al. ..... 49/484 X 4,027,431 6/1977 Rackard ..... 49/458

*Primary Examiner*—Kenneth Downey

*Attorney, Agent, or Firm*—John W. Logan, Jr.

[57] ABSTRACT

A window assembly having a formed frame comprising left and right window jambs, a sill plate jamb and a top plate jamb for hanging a plurality of window panes, as well as an outside screen, these panes each carrying a first and second weather seal, the first seal of which meets a juxtaposed surface on the frame normal to that pane of glass, the second seal being positioned from the first seal to meet with a surface canted from the position of the first frame surface on the mating jamb.

10 Claims, 7 Drawing Figures

FIG. 7.
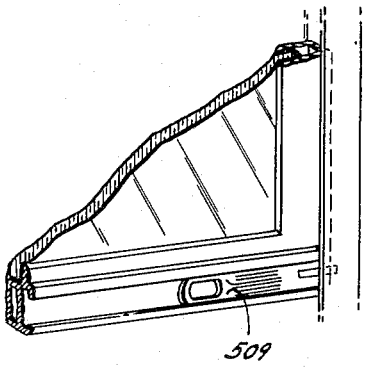
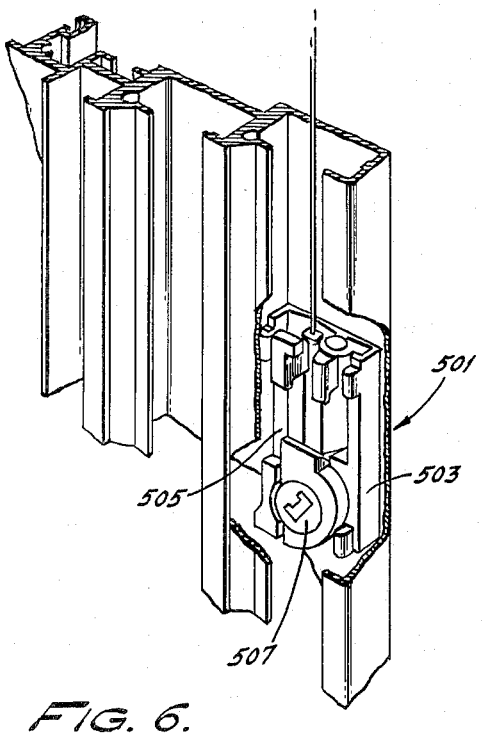
FIG. 6.
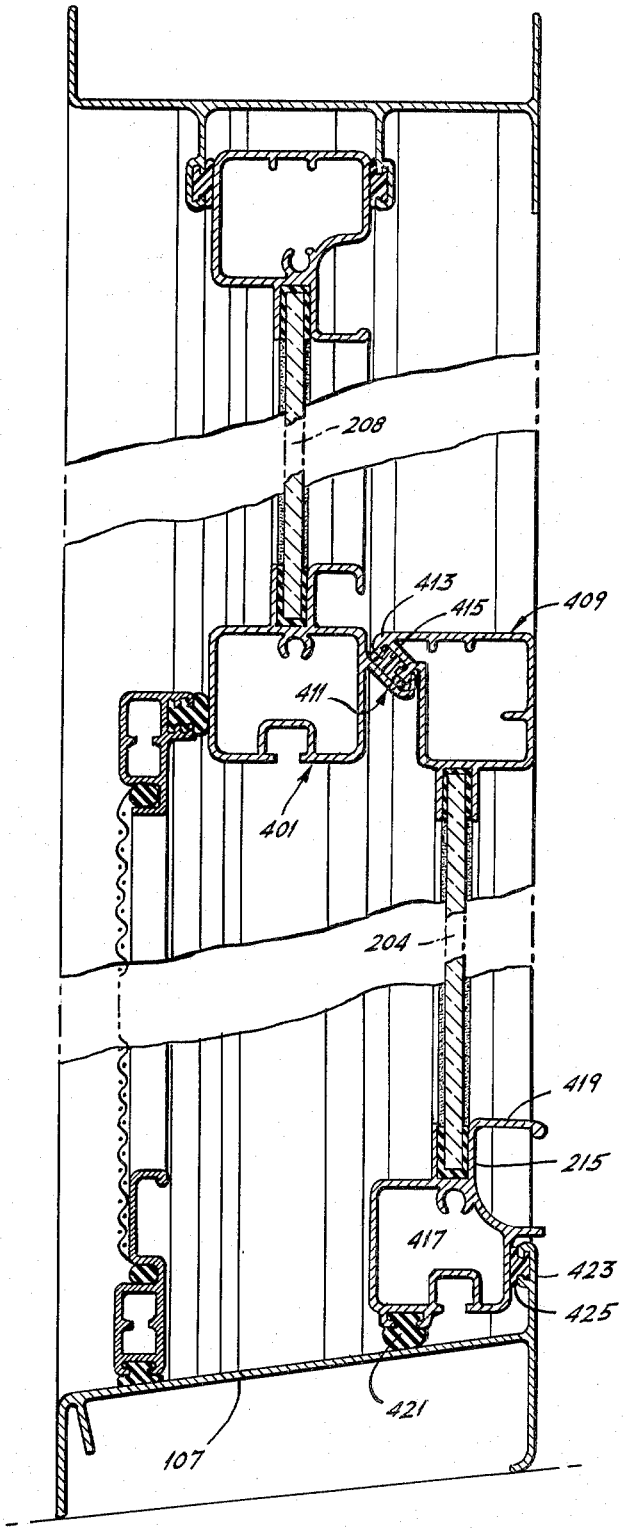
FIG. 5.

NARROW PROFILE JAMB WINDOW

BACKGROUND OF THE INVENTION

This invention relates to window assemblies and more particularly to an integral window assembly capable of being used as a replacement window.

In the building industry, it is common to install replacement windows in both residential and commercial buildings where the original windows have become inoperative through deterioration, or undesirable because of style or inefficient due to excessive heat loss. Energy considerations in recent years have prompted the continuing development of extruded aluminum window assemblies which minimize heat conduction and "dead air" spaces for insulation as an integral part thereof when installed. These window assemblies, especially when used with double hung or sliding windows have in general incorporated the use of a rope, fiber, bristle or vinyl tube type seal as part of the framing around each movable window glass pane, these seals taking up the space or tolerances provided in manufacturing between the movable window portions and the frames, tending to provide a wind and air seal thereby, and acting as the bearing surface during the movement, e.g. raising or lower, of each window pane.

Typically, each window pane has such a seal running around the perimeter of its glass frame and facing outwardly for mating against a lip or projection on the outside frame of the window (side jambs and top and bottom plates). This single seal, however, proved insufficient as consumer energy needs demanded better and tighter window sealing. It, therefore, has been a recent practice to include a second seal on each movable window frame. This second seal has been positioned to face the jamb directly.

The design of plural hung windows, such as double hung residential windows, with each movable window pane being removable from the frame assembly in a given direction, such as into the building, has necessitated a window jamb structure having considerable thickness or height. This thickness or height has been increased by the use of double seals on each window frame, as the window assembly must provide a mating or seating surface for each seal.

These high profile window assemblies have the disadvantage, when used especially as replacement windows, that the opening remaining when the window panes are removed is too small for accessing and passing easily an outside storm pane previously installed on the structure and sized for the original window opening.

An object of this invention is to provide a low profile frame window assembly with reduced window frame thickness or height.

The second object of this invention is to provide such a reduced profile window frame assembly with two mating surfaces for mating with each movable window pane, each such surface meeting with a seal member part of the frame around the pane.

An even further object of this invention is to provide such a window assembly where the window pane frame carried seals are carried on surfaces positioned at a 45° rotation from one another and such corresponding seating surfaces on such frame assembly meet therewith.

SUMMARY OF THE INVENTION

The objects of this invention are achieved by a double hung replacement window assembly constructed from preformed material whereof the window frame may be of extruded material and pre-assembled. The frame may provide track for an outer and inner movable window panes as well as an outside screen section. These tracks include flat parallel running faces upon which corresponding juxtaposed faces of the frame about each individual window portion pane is seated. The second face for each track is formed by a shoulder canted at an angle from the first face.

Each window movable pane is framed by preformed material, such as an extruded metal frame, having a pair of seals each within a receiving and holding channel, each being positioned canted at an angle from one another and running parallel to one another.

The faces of the movable window pane frame and the respective frame tracks are left essentially open. A top support pin and bottom release pin member is utilized on each window pane frame for protruding into the adjacent assembly frame for securely holding each such movable window pane in its respective track while allowing it to slide on that track. The locking pins are movable and spring biased to the "locked" position, permitting removal of each movable window portion from the assembly.

DESCRIPTION OF THE DRAWINGS

The advantages, features and operation of this invention will be best understood from a reading of the following detailed description of the invention in conjunction with the attached drawings in which like numerals refer to like elements and in which:

FIG. 5 shows a broken cross-section taken vertically through the assembly at 5—5 of FIG. 1.

FIG. 6 shows a broken perspective view of the side jamb window assembly showing the locking sash component taken at 6—6 of FIG. 1.

FIG. 7 shows a partial perspective view of the window assembly including the pivot pin sash mating member on the movable window portion for holding that portion into the frame.

DETAILED DESCRIPTION OF THE INVENTION

Figure 1:
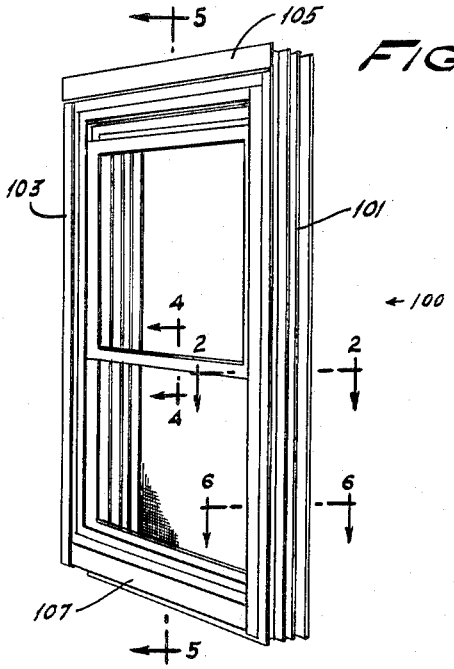
FIG. 1 is a perspective view of the whole window assembly.

A window assembly 100 for use in original construction or as a replacement unit. FIG. 1, contains a plurality of movable window panes held in separate tracks as well as a removable screen. The movable window portions or panes, are also removable from the assembly. As seen in its preferred embodiment, FIG. 1, the window assembly has double hung windows, in a one-over-one configuration, of the sash type, whereof the frame is of extruded or formed material, such as aluminum, having a narrow profile which allows a larger opening than previously. This larger opening is desirable in replacement applications as it permits the passage of the movable window panes from an outer pre-existing storm window, easily, and without binding or distorting the storm window portion or the frame of the subject invention.

FIG. 1 shows the perspective view of the window assembly 100 from the inside thereof. Here the side jambs 101 and 103 are viewed both from their building abutment and from their track side, respectively. The frame 109 of the assembly is completely assembled with the top plate 105 and bottom plate 107 joined to the side jambs 101, 103 before installation into a window opening. The window assembly 100 can be secured by screwing, nailing or otherwise attaching the frame portion 109 to the existing building structure.

Figure 2:
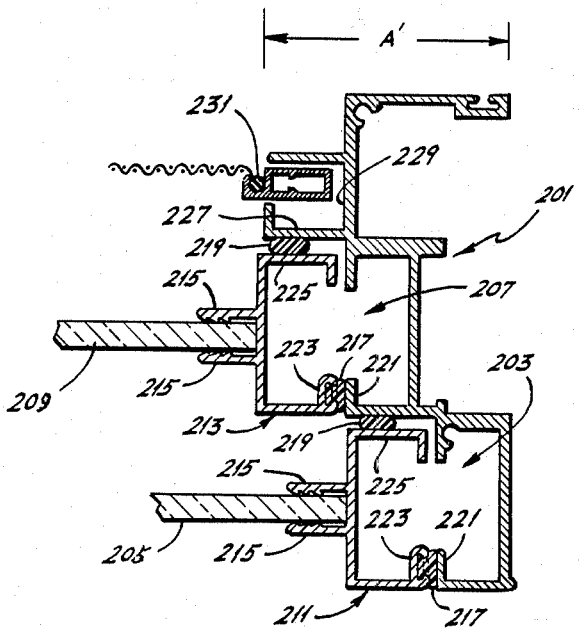
FIG. 2. PRIOR ART
FIG. 2 is a partial cross-section through the side window jamb at approximately mid-assembly as taken at 2—2 in FIG. 1.

Prior art window assemblies, of a type which are made of extruded construction, such as shown in cross-section in FIG. 2, and which incorporate at least two seals around the periphery of the movable window pane, have of necessity a window frame of a certain height to accommodate double hung windows. Each such movable window pane 205, 209 operates within a different track, and are removable, usually to the interior of the building. These window assemblies have a frame as exemplified by the side jamb 201 shown in cross-section, which is made of extruded metal such as aluminum and which provides a first track 203 for a first movable window pane 205 and a second track 207 for a second movable window pane 209.

The side jamb frame 201 is extruded forming two "C"-shaped sections to create the first and second tracks 203, 207. With the window panes 205 and 209 installed in place, a hollow air pocket or cavity can be created which adds to the insulating qualities of the window. Likewise, the frames 211, 213 as part of the first and second window panes 205, 209, also in cross-section, take a "C"-shape with a pair of projecting flanges 215 from the outside center of the web portion of each "C" frame 211, 213 for holding the glass panes 205, 209.

The first track 203 is positioned laterally outwardly from the location of the second track 207 so that the frame portion forming this track 203 is offset from the other portion 207 and further from the center of the window opening. This necessitates a larger first inner window 205, than the slightly smaller outer window 209. The difference in size between the inner window 205 and the outer window 209 allows for the removal, inwardly, of both the inner and outer windows 205, 209.

A first and second seal 217, 219, respectively, extend around each of the frames 211, 213 of each of the window portions 205, 209. These seals are rope type, bristle type, vinyl pillow type or of other construction acceptable in the industry to form a draft barrier between movable parts and which provide a friction reducing riding surface when the windows 204, 208 are moved on the frame 201. In the past, two seals have become acceptable practice with insulative type widow assemblies. With the construction of FIG. 2, the first seal 217 abuts the inner lip 221 of its respective "C"-shaped frame portion, this seal 217 being attached to the inner lip 233 of the "C"-shaped window frame 211, 213.

The second seal 219 has been placed on the outer face 225 of the respective window frame 211, 213. As to the inner window frame 211, its outer or second seal 219 rides against the inwardly facing flange portion of the second "C"-shaped track.

Similarly, the second or outer seal 219 of the second or outer window frame 213 rides against an inwardly facing frame member 227 which is offset inwardly from the track 207 and which forms part of an insert track 229 for receiving and holding a screen frame 231. This screen frame 231 is of the same approximate size as the smaller or outer window 208.

The inwardly facing faces against which the outer seal 219 rests project inwardly from the main frame web portion a distance approximately equal to the thickness of the respective window frames 211, 213. This provides an overall window frame profile with a thickness A'. This thickness A' is of interest especially in replacement window applications as it defines the remaining free space within the frame through which outer storm windows may pass or be accessed when the windows of the main window assembly have been removed.

Figure 3:
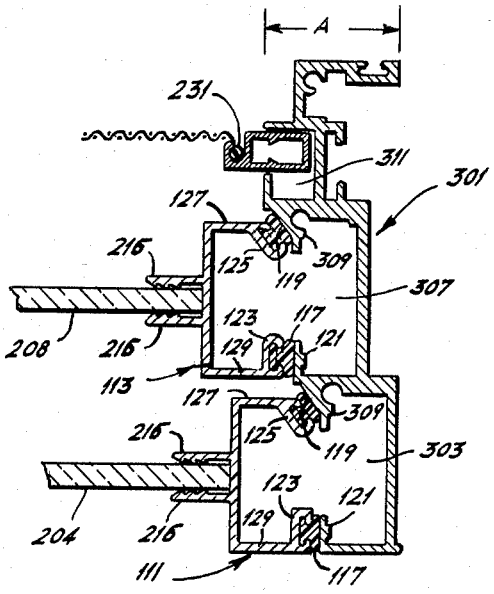
FIG. 3 shows a corresponding cross-section through a side jamb of the prior art window design.

The window assembly of the subject invention provides a narrower or lower window frame profile where the dimension A, FIG. 3, is much less than that of the prior art, in the magnitude of 25 to 50% less than the prior art. For the same size building opening for receiving the assembly 100, this will provide a much larger free space with the windows 204, 208 removed. These window panes 204, 208, as well as the outer screen with its respective frame 231 are of a larger size than the corresponding elements of the window in the prior art. The inwardly facing portion of the first window frame 111 and the second or outer window frame 113 are of similar size as the prior art frames 211, 213, respectively. Each of the windows 204, 208 are held to its respective frames 111, 113 by similar flanges 216 extending outwardly from the web portion of each window frame 111, 113.

Each movable window pane's frame 111, 113 carries an inner and outer seal 117, 119, respectively. The inner seal 117 of each frame 111, 113 is positioned to abut the respective inner lip 121 of the side jamb frame 301 at its respective track 303, 307 as this seal is mounted to the inner lip 123 of each movable window portion 111, 113. The outer seal 119 is positioned on the outer lip 125 of each of the frames 111, 113. This lip is canted at an angle from the inner lip 123, this angle being less than 90° such as from 30°–60° and preferably at about 45°. The smaller this angle, of course, the narrower the profile which is made possible. The edge of the outer lip 125 is aligned along the same parallel projection as the inner lip 123, thereby the outer face 127 of each frame 111, 113 is considerably shorter, by approximately 20–25% than the inner face 129 of each frame 211, 213 of the prior art FIG. 2. The first or inner window frame seal 117 is positioned in a first plane extending parallel to the face of the assembly frame 301. The second or outer window frame seal 119 is positioned in a second plane rotated at an angle of less than 90° from the first plane. It is the cosine of this angle which contributes to a determination of the width of the frame 301 and the dimension A which defines the narrow profile window.

The frame 301 provides the mating, seating surfaces on the inner lips 121, 309 of the tracks 303, 301, respectively, against which the seals 117, 119 seat in juxtaposed position forming a draft and weather seal. The inner lip 309 seating surface is also positioned or canted in a plane which extends rotated a given number of degrees or angle from the first plane, this rotated position being less than 90 degrees.

The frame 301, FIG. 3, provides two tracks 303 and 307 against which the first and second movable window frames 111, 113 operate, respectively. These tracks 303, 307 are formed by essentially "C"-shaped cross-sectional extruded members with the inner track 303 being offset slightly from the outer track 307 to provide for a slightly larger inner opening for the slightly larger inner movable glass pane 204. The outer seal 119 on the canted lip 125 of each frame 111, 113 mates against a canted flange or outer lip for each of the tracks 301, 307. This permits a seal 119 which is as wide or wider than used in the prior art. Because of the canting, the projection, onto the plane of the window opening, of this seal 119 is considerably less, approximately equal to a function of the cosine of the angle of cant from the plane of the opening. The seal 119, in its respective canted seating surface 309, therefore, takes up less of the opening and allows for a narrower profile frame 301.

The track 311 formed for receiving the screen frame 231 can also be of narrow profile. The screen and its frame 231 are quite light and are not of critical dimensions as are the windows and their respective seals 119, 117. The profile of this screen track 311 can be reduced in keeping with the concept of providing for a wider opening or free space with all inserts removed. While FIG. 3 illustrates the right side jamb of the assembly 100 in cross-section, it is understood that the left or other jamb follows mirror or reversed image of the right.

The side jamb tracks 303 and 307 extend the entire length of each of the side jambs 101 and 103. A slot is cut through the inner face of each track 301, 307 at an appropriate place to allow a pin which is welded to the top of each movable window pane frame 111, 115 to slide through. This is a typical design feature accepted in the industry and one which allows for removal of the window panes 204, 208 inwardly into the building. The bottom and top portions of the movable window frames 111, 113 are constructed of essentially rectangular tubular construction with no open faces as are the side portions 111, 113.

Figure 4:
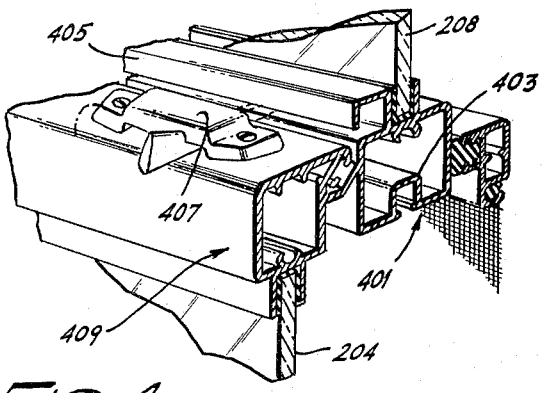
FIG. 4 shows a partial perspective view in cross-section taken through the window pane inserts at 4—4 and showing the movable portion lock.

The bottom frame member 401, FIG. 4, is essentially rectangular with a formed protrusion or slot 403 in the bottom face thereof. The inner flange 215 extending from the top face of this frame portion 401 has an additional flange portion 405 extending inwardly and downwardy in a "J" or "L"-shaped fashion to provide a locking surface against which a latch 407 mounted to the top frame member 409 of the inner window 204 pane.

Both the bottom frame portion 401 and of the bottom pane 204, FIG. 5, carry curved projecting flanges 411, 413, respectively, projecting outwardly at angles from the horizontal to overlap and inter-lock when the pane 204 is fully down and the pane 208 is fully up. The bottom window overlapping flange 413 carries a seal 415 held in a slot thereof.

The bottom portion 417 of the bottom or inner pane 204 carries an inwardly projecting flange 419 from the outer edge of its window or glass securing flange 215. This provides a grasping surface for raising or lowering that window pane 204. A seal 421 is carried in a slot on the bottom face of that bottom frame portion 417. This seal 421 abuts the face of the sill plate 107 of the window assembly when the window pane 204 is closed, i.e. fully down.

The sill plate 107, FIG. 5, of the assembly 100 frame 109 is a flat surface member having an upwardly projecting inner flange 423 on inner side thereof, this flange 423 carrying a seal 425 which mates against the inner face of the bottom frame portion 417 when the bottom pane 204 is closed, i.e. fully down.

The sill plate 107 tapers downwardly from its inner side 423.

A sash member 501, FIG. 6, rides within the track openings 303 and 307 on either side of the movable window portions 204, 208. This sash member 501 can be constructed of a molded or injected configuration of aluminum, nylon, plastic or other material. The sash member is assembled to include two longitudinally extending portions 503, 505 and a rotatable barrel member 507 which contains a flat portion which allows the sash member 505 to slide up and down by permitting the longitudinal members 503, 505 to come closer together than otherwise. When the barrel member 507 is rotated to spread the longitudinal members 503, 505 apart, the sash member 501 becomes jammed within the window frame thereby assuring its steady location thereof.

Barrel member 507 contains a key slot having a "C" configuration for ease of orientation with respect to the flat portion of this barrel member 507.

Each window pane 204, 208, 209 frame bottom portion contains a retractable and pivotal pin 509, FIG. 7. This pin, 509, when inserted in the barrel member 507, supports the bottom of each window frame 403, 409. With a window pane 204, 208 positioned so that the top part with its retaining pin is adjacent to a respective slot in the window frame 109 so that the window may be rotated inwardly into the building, the pin 509 causes the barrel member 507 to be rotated and securely positioning the sash member 501. The pins 509 extending outwardly on each side of the bottom of each window portion can then be retracted enabling the complete removal of the window.

The structural materials used in the manufacture of the subject invention narrow profile window, assembly, FIG. 3, are similar to those described for the prior art window, FIG. 2. The frame 301 is of extruded aluminum and the same selection of materials are used for the seals 117, 119, 415, 421, 425.

Many changes can be made in the above-identified narrow profile window assembly without departing from the intent and scope thereof. It is intended, therefore, that all matters contained in the above description and shown in the accompanying drawings be not taken in the limiting sense but be interpreted as illustrative of the invention.

What is claimed:

1. A window assembly comprising:

means securable to a building for holding a plurality of movable window panes mounted in frames;

a first window pane surrounded by a frame part thereof held by said holding means and slidable therein;

a first and second mating surfaces on said holding means for mating with the frame part of a said pane and forming the track against which said frame part slides;

a first and second sealing means on said frame part of said pane for sealing against each of said holding means formed track mating surfaces, said second sealing means being positioned in a plane rotated less than 90 degrees from the plane in which said first sealing means is positioned.

2. The window assembly of claim 1 wherein said first and second seating surfaces are positioned rotated between 30 and 60 degrees from one another.

3. The window assembly of claim 2 wherein said first and second seating surfaces are positioned rotated 45 degrees from one another.

4. A narrow profile jamb window assembly comprising:

a window jamb forming a frame and having a plurality of tracks for holding a plurality of sliding window panes;

a pair of first and second surfaces extending parallel along both of opposite sides of said window jamb, said pairs of surfaces each forming the track against which said window panes slide;

a plurality of window panes, each mounted in a frame, said frame having first and second surfaces for seating against said jamb track surfaces;

sealing means mounted on said frame seating track surfaces;

wherein said first and second surfaces on said window pane frame and on said window jamb are positioned rotated from one another but at an angle less than 90 degrees.

5. The window assembly of claim 4 wherein said angle of rotation between said first and second seating surfaces is 45 degrees.

6. The window assembly of claim 5 wherein said window jamb track is formed by a "C" shaped cross-section extruded member, said first and second seating surfaces being the lips of said "C" section.

7. The window assembly of claim 6 wherein said window jamb plurality of tracks includes a second said track formed adjacent to a first, the first one of said tracks disposed inwardly and offset to the side from said second track.

8. The window assembly of claim 7 wherein said jamb also includes a bottom sill member being a flat surface tapering downwardly from one side thereof and having an upwardly projecting flange on said inner side, said seal for mating.

9. The window assembly of claim 8 wherein a first window pane operates in said first track, and a second window pane operates in said second track.

10. The window assembly of claim 9 wherein said first window pane frame top portion carries a first projecting flange angled from the horizontal and wherein said second window frame carries a second projecting flange angled from the horizontal, said first and second projecting angled flanges overlapping and interlocking when said first and second window panes are at opposite extreme positions within said assembly.

* * * * *